US006843414B2

(12) United States Patent
Madrid et al.

(10) Patent No.: US 6,843,414 B2
(45) Date of Patent: Jan. 18, 2005

(54) SMART CONTAINER FOR BULK DELIVERY

(75) Inventors: Alejandro R. Madrid, Breda (NL); Rick Roberts, Santa Clara, CA (US); Hans-Ulrich Hahn, Neustadt (DE); Jim Seagoe, Santa Clara, CA (US)

(73) Assignee: Honeywell International Inc., Morristown, NJ (US)

( * ) Notice: Subject to any disclaimer, the term of this patent is extended or adjusted under 35 U.S.C. 154(b) by 131 days.

(21) Appl. No.: 09/825,380

(22) Filed: Apr. 2, 2001

(65) Prior Publication Data

US 2002/0139840 A1 Oct. 3, 2002

(51) Int. Cl.[7] ..... G06F 17/60

(52) U.S. Cl. ..... 235/385; 235/375; 235/486; 235/383; 340/618; 340/623

(58) Field of Search ..... 235/375, 486, 235/383, 384, 385, 492, 382; 340/618, 623, 449, 450, 612

(56) References Cited

U.S. PATENT DOCUMENTS 5,351,725 A * 10/1994 Suthergreen et al. ..... 141/1
5,461,906 A * 10/1995 Bogle et al. ..... 340/618
5,627,523 A * 5/1997 Besprozvanny et al. .... 340/612
5,708,424 A * 1/1998 Orlando et al. ..... 340/870.08
5,947,372 A * 9/1999 Tiernan ..... 236/94
5,969,606 A * 10/1999 Reber et al. ..... 340/540
5,986,553 A * 11/1999 Young ..... 340/606
6,094,142 A * 7/2000 Lu ..... 340/626
6,209,592 B1 * 4/2001 Gilboa et al. ..... 141/351
6,229,448 B1 * 5/2001 Bennett et al. ..... 340/618
6,271,753 B1 * 8/2001 Shukla ..... 340/545.6
6,307,483 B1 * 10/2001 Westfield et al. ..... 340/310.06
6,336,362 B1 * 1/2002 Duenas ..... 73/313
6,385,407 B1 * 5/2002 Inose ..... 222/DIG. 1
6,418,283 B1 * 7/2002 Wegman et al. ..... 116/100
6,490,922 B1 * 12/2002 Sprea et al. ..... 73/313

* cited by examiner

*Primary Examiner*—Michael G. Lee
*Assistant Examiner*—Ahshik Kim
(74) *Attorney, Agent, or Firm*—Bingham McCutchen; Sandra P. Thompson

(57) ABSTRACT

A smart fluid storage container assembly and methods of using the container assembly. The container assembly includes features that minimize the risk of degradation of any fluid or other material contained in the container, provide for monitoring of the conditions the fluid has and is being subjected to, and provide for storage of identifying information and other data with the container itself. The information accompanying the container can be used to identify the contents of the container and/or the proper storage and use of the material contained within the container.

16 Claims, 2 Drawing Sheets

FIG. 3
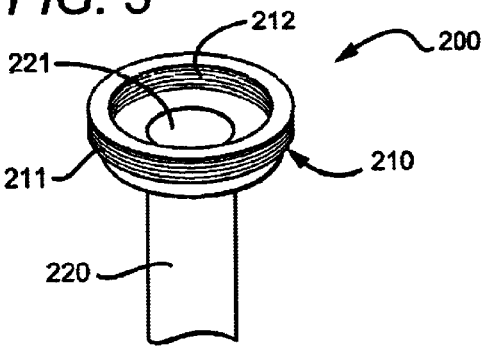
FIG. 4A
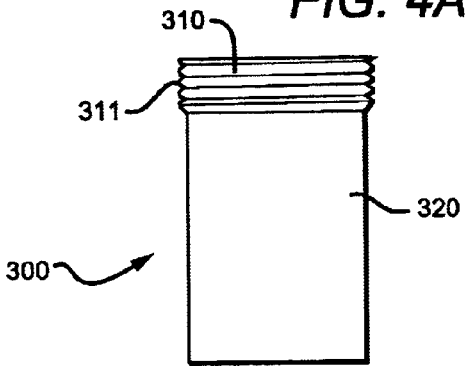
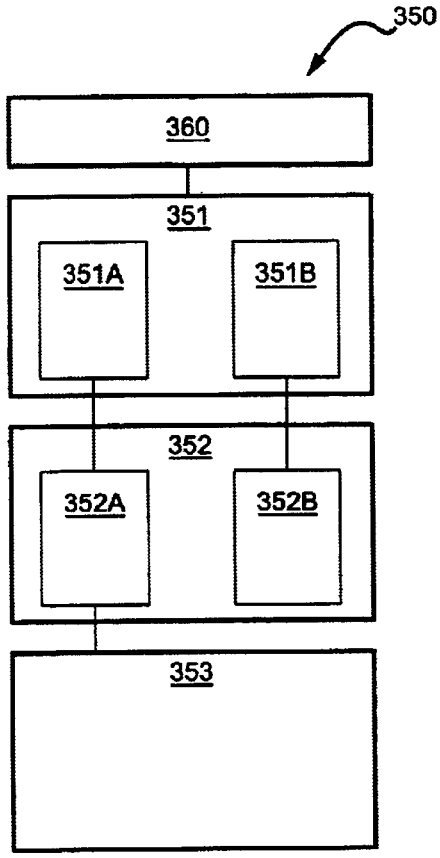
FIG. 4B
FIG. 5
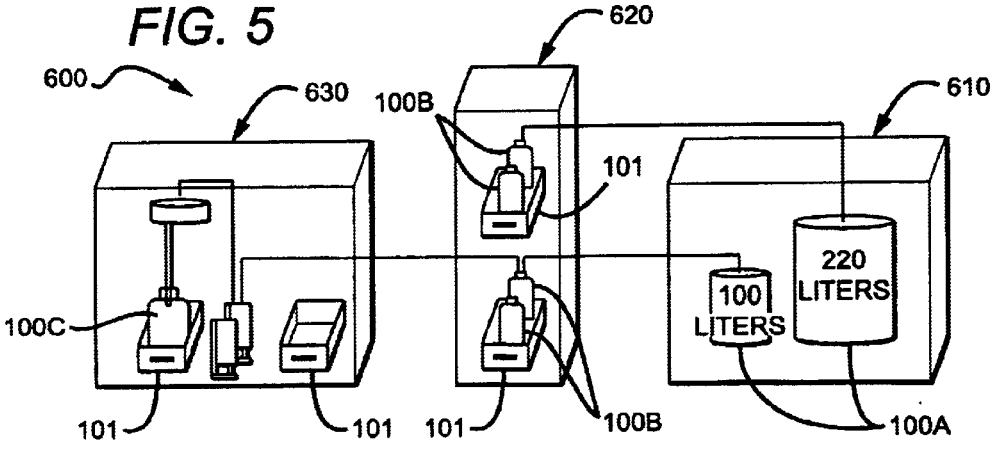

SMART CONTAINER FOR BULK DELIVERY

FIELD OF THE INVENTION

The field of the invention is fluid storage containers.

BACKGROUND OF THE INVENTION

Many industries require the use of costly materials that can easily be contaminated or otherwise rendered unsuitable for use through improper handling or through storage container failure. Unfortunately "minor" failures in a storage container or improper handling often go undetected until the use of a material corrupted by such a failure or by improper handling causes problems at a later point in a production process. Even when material corruption is detected prior to use, having to dispose of an entire container of a costly material is undesirable. As a result, less efficient smaller containers are generally used to transport such materials so that contamination of the material within a container has minimal impact. Unfortunately, the use of small containers may tend to increase production costs, possibly as a result of the added complexity caused through the use of larger numbers of small containers rather than fewer larger containers.

Spin-on-glass is a costly material that is generally transported in containers able to hold a gallon or less of spin-on-glass. Spin-on-glass containers are typically bottles comprising a single threaded opening into which a cap/plug is inserted during transportation and storage, and into which a dip tube assembly coupled to a hose or pipe fitting is inserted while the spin-on-glass is being extracted from the bottle. Contamination of spin-on-glass often occurs because of the introduction of dried spin-on-glass (typically dried because it was exposed to air) into a container during removal of a seal cap or insertion of a dip tube assembly. Removal of a seal cap may introduce dried spin-on-glass into the container because very small leaks may form in the seal area where the cap/plug is inserted into the storage bottle with such leads causing dried spin-on-glass to accumulate in the seal area. Subsequent removal of the cap/plug may result in the dried material falling into and containing the contents of the container. Insertion of a dip tube assembly may introduce dried material if the dip tube assembly was previously used in another bottle of spin-on-glass and material dried on the dip tube assembly while it was being moved between bottles.

Spin-on-glass is sensitive to temperature, so corruption may also occur during transportation or storage as a result of not maintaining the spin-on-glass at an appropriate temperature. Although known devices and methods are capable of monitoring the temperature of the environment surrounding a container such as a bottle containing spin-on-glass, such monitoring is often inadequate because the environment surrounding a container does not accurately reflect the environment within the container.

Thus, regardless of whether the deficiencies described were previously recognized, there has been and continues to be a need for improved methods and devices for the storage and transportation of high purity materials.

SUMMARY OF THE INVENTION

The present invention is directed to a smart container for bulk delivery. As used herein, a smart container is one that is able to electronically provide information regarding its contents. Such information may be information programmed into or transmitted to the container, or information recorded by the container itself. Information programmed into the container may include critical product information that can be used to verify the contents of the container prior to use of any material it contains. Information recorded by the container itself may be obtained by incorporating one or more sensing devices that can monitor container integrity during shipment by monitoring temperature, position, chemical sensor, pressure, etc. Such sensing devices are incorporated in a manner that prevents any direct contact between the sensing devices and the material stored within the container in order to minimize opportunity for leaks or material contamination. The use of high purity compatible materials for wall construction and hermetic seal design also facilitate use of the container for storage of high purity materials. Although particularly well suited for the storage of spin-on-glass, the container can meet other industry needs such as pharmaceutical, agricultural, or industrial where the integrity of the material, cost, or safety are a big concern.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 3 is a perspective view of a dip tube assembly.

FIG. 4A is a side view of a cylindrical monitoring assembly.

FIG. 4B is a block diagram of an electronics assembly which is part of the monitoring assembly of FIG. 4A.

FIG. 5 is a schematic view of various sized containers being used in a manufacturing process.

DETAILED DESCRIPTION

Figure 1:
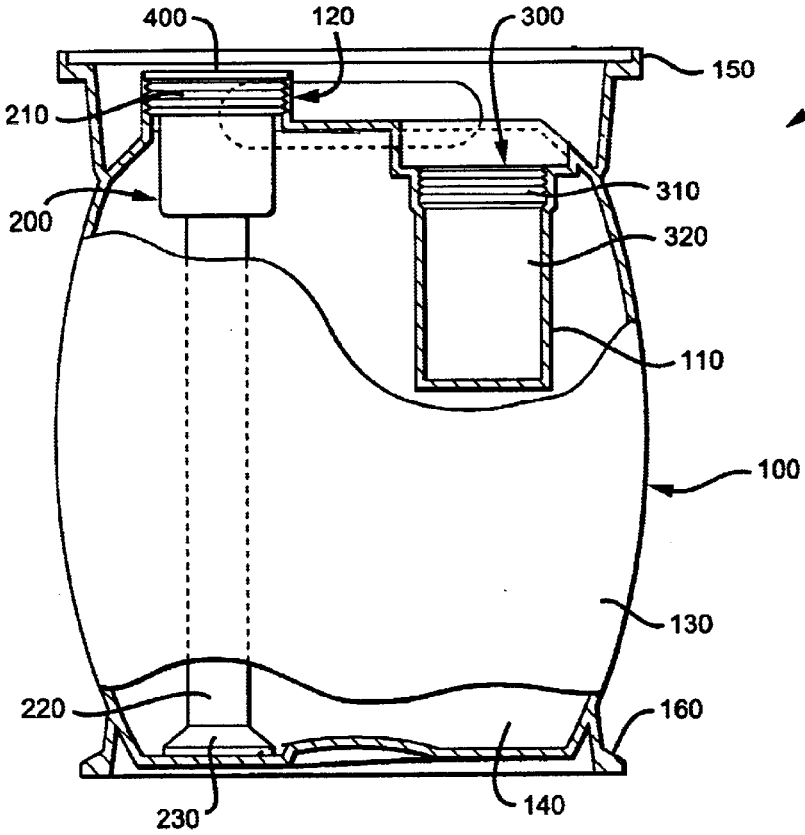
FIG. 1 is a side, partial cutaway view of a container assembly embodying the invention.
Figure 2:
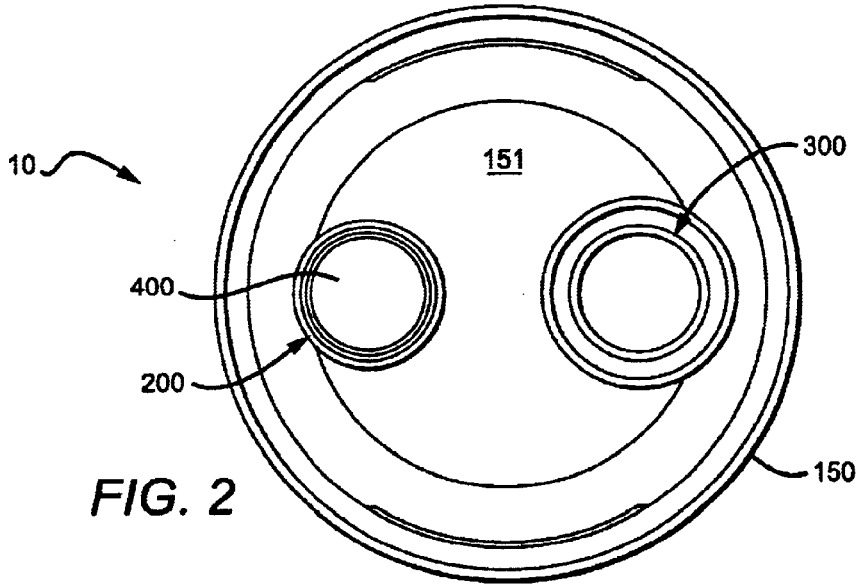
FIG. 2 is a top view of the assembly of FIG. 1.

Referring first to FIGS. 1 and 2, a smart container assembly 10 comprises storage container 100, a dip tube assembly 200, a monitoring assembly 300, and a dip tube seal cap 400. Container 100 comprises a monitoring assembly receiving cavity 110, a dip tube orifice 120, an outer wall 130 surrounding a storage cavity 140, top 150, and base 160. Dip tube assembly 200 comprises internally and externally threaded connector 210, dip tube 220, and inlet end 230. Monitoring assembly 300 comprises a top, threaded portion 310 and a bottom portion 320.

Storage cavity 140 of container 100 is filled with a fluid to be stored in the container via dip tube orifice 120 (which acts as a bunghole for the container), preferably while dip tube assembly 200 is absent. After filling the container, dip tube assembly 200 is used in conjunction with seal cap 400 to hermetically seal the container 100. When access to the fluid stored in container is necessary, seal cap 400 is removed while dip tube assembly 200 is left in place and fluid stored in storage cavity 140 is withdrawn through inlet 230 and tube 220 of dip tube assembly 200.

After filling (or possibly before or during filling) monitoring assembly 300 is inserted into cavity 110 in a manner that results in monitoring assembly 300 being retained in cavity 110. Cavity 110 protrudes into storage cavity 140 so as to best position monitoring of the contents of cavity 140 by monitoring assembly 300 without monitoring assembly 300 contacting any material stored in cavity 140. Monitoring assembly 300 may be inserted and removed from cavity 110 without breaking the hermetic seal of cavity 140.

The container 100 may be sized and dimensioned in any number of ways, and may be made from any number of materials or combinations of materials with the actual size and dimensions and materials used for a particular embodiment being chosen to produce a container suitable for its intended use. For semiconductor application, materials of construction with low levels of extractable metals, organic extractable materials, and particles is desired. Although the smart container assembly may be comprised of a variety of suitable materials, it is currently preferred that container 100 be formed from high-density polyethylene (HDPE) or, less preferably, polymethylpentene, nylon, or Fluorinated Ethylene Propylene (FEP) Teflon resins. Although many different types of dip tube assemblies may be used, it is currently preferred to use a flexible, plastic dip tube assembly.

Monitoring receiving cavity 110 is preferably sized, dimensioned, and constructed to permit sensing of the conditions within storage cavity 140. Although in the currently preferred embodiment the walls of cavity 110 are formed from the same material as, and are one piece with the walls 130 of storage cavity 130, alternative embodiments may have a receiving cavity 110 having walls that are thinner than those of storage cavity 140 or that are made from a material or combination of materials different than those of cavity 140. Receiving cavity may also comprise a separate piece or assembly from walls 130 of cavity 140. It is preferred that receiving cavity 110 and monitoring module 300 interact so that any sensors within receiving cavity 110 sense conditions more similar to those of the contents of the container than the environment surrounding the container. As such, it is currently preferred that receiving cavity 130 protrude into storage cavity 140 and not protrude out of container 100. For embodiments in which walls 130 comprise a thermally insulating material, all or portions of cavity 130 may comprise a more thermally conductive material if sensing the temperature of the interior of cavity 140 is desirable. Other variations in the construction of cavity 130 may be included as needed. As an example, if sensing motion within cavity 140 is desirable, cavity 130 may be designed to be affected by motion of the contents of cavity 140, perhaps by making cavity 130 from a flexible material and including a motion sensor within cavity 130. If changes in pressure within cavity 140 are to be monitored, isolating cavity 130 from the effects of pressure changes occurring outside of container assembly while making at least a portion of cavity 130 flexible enough to cause the pressure within cavity 130 to change in response to changes in pressure within storage cavity 140 may prove beneficial.

Dip tube orifice 120 is preferably the only opening into storage cavity 140 so that hermetically sealing orifice 120 is all that is needed to hermetically seal cavity 140. Dip tube orifice 120 is preferably threaded to allow dip tube assembly 200 to be inserted, tightened, and sealed into orifice 120.

Referring to FIG. 3, a preferred dip tube assembly 200 comprises a connector 210 having external threads 211 and internal threads 212 and a dip tube 220 having a hollow cylindrical center 221 through which material can flow and exit container 100 when seal cap 400 is not screwed into the end of the dip tube assembly 200. When material is being extracted from container assembly 100, a hose or pipe is generally connected to the container 100 via a connector (not shown) screwed into the internal threads 212 of connector 210 of dip tube assembly 200. It is contemplated that the dimensions and/or tolerances of external threads 211 and internal threads 212 may differ from each other. It is also contemplated that connector 210 may be sized and dimensioned in a manner relating to the contents of the container such that the connector cannot be coupled to a hose or pipe that is not intended to receive the contents of container assembly 10.

Referring to FIGS. 4A and 4B, a preferred monitoring assembly 300 comprises a threaded upper portion 310, a sensor containing portion 320, and at least one electronics assembly 350. Threads 311 of threaded upper portion 310 ate sized and dimensioned to permit monitoring assembly 300 to be screwed into monitoring assembly receiving cavity 110. It is contemplated that in some embodiments a portion of monitoring assembly 300 will help insulate the any sensors or other electronics that are part of monitoring assembly 300 from the environment surrounding container assembly 10. Insulating sensors and electronics in such a manner may provide numerous advantages. A first is that the sensors and electronics are protected by the container 100. A second is that there is no need to separately transport monitoring assembly 300 which decreases the risk that a particular monitoring assembly 300 will become lost or will be associated with a different container 100 than it was originally associated with. A third, and possibly one of the more important reasons, is that any sensors that are part of monitoring assembly 300 will be more likely to sense conditions that more closely reflect the conditions of the material being stored within container 100 than the conditions of the environment surrounding the container.

It is contemplated that some embodiments of monitoring assembly 300 will comprise an input/output (I/O) interface 351, a recording mechanism 352, and a sensing mechanism 353. Recording mechanism 352 is electrically coupled to both the sensing mechanism 353 and the I/O interface 351 for recording data obtained from both the sensing mechanism and the I/O interface. Data obtained from the I/O interface 351 will generally originate from an external source/device 360 and pass through I/O interface 351 to recording mechanism 352. Such data may include but is not necessarily limited to a product identifier, a lot number, and/or an expiration date. Data recorded from the sensing mechanism may be translated and/or retrieved from recording mechanism 352 via I/O interface 351 as a series of flags. As an example, monitoring assembly 300 may be programmed with a temperature range within which the contents of the container are to be maintained, and, if it senses a deviation outside of the acceptable range, may set a flag indicating such a deviation. Incorporating more "intelligence" in monitoring assembly 300 can thus decrease the amount of raw data to be recorded by recording mechanism 352.

I/O interface 351 may comprise any device or devices which support communication between the monitoring assembly 300 and an external device or operator. Such devices may simply comprise one or more connectors, plugs, adapters, or other devices suitable for establishing an electrical, optical, acoustic, or other communication channel connection between monitoring assembly 300 and an external device, or may include a transmission mechanism supporting "wireless" communications between the monitoring assembly and an external device. Alternative embodiments may incorporate devices permitting human interaction with the monitoring assembly 300 such as a visual display, an acoustic generator, a keyboard, switches, dials, and/or buttons.

I/O interface 351 may comprise multiple sub interfaces such as sub interfaces 351A and 351B with each sub interface proving the capability to send and receive data to different sub mechanisms such as 352A and 352B. The use of multiple sub mechanisms within recording mechanism 352 permit each sub mechanism to perform a specialized task. Thus, while sub mechanism 352B may be designed to retain information transmitted to it from sub interface 351B, sub mechanism 351A may be designed to record data obtained from sensing mechanism 353 with sub interface 351A providing an interface for retrieving the information from sub recording mechanism 352A.

It is contemplated that monitoring assembly 300, probably through I/O interface 351, will communicate with an external device 360. Device 360 may be a handheld unit designed to allow "on the spot" querying of monitoring assembly 300, or may be a control device which is part of the processing system which will be using the contents of container assembly 10. If part of the processing system, the information contained in monitoring assembly 300 can be used to insure that the contents will not be used unless they are of a type suitable for the process and/or have been handled in a manner that does not render them unfit for use in the process.

Monitoring assembly 300, and particularly sensing mechanism 353 may be designed to sense one or more environmental conditions within container 100 such as temperature, and possible pressure, motion, and/or mechanical shock.

Seal cap 400 is preferably sized and dimensioned to be screwed into the end of dip tube assembly 200 rather than into dip tube orifice 120.

Referring to FIG. 5, smart containers 100A, 100B, and 100C may be used in a production facility 600 to provide material to device 640. Containers 100A may be fairly large, such as 100–220 liters and contained within a bulk delivery unit 610. Containers 100B may be smaller and fitted within trays 101 for use in mini delivery unit 620. Container 100C may be used to store unused material leaving device 640, and may be positioned in processing area 630 in proximity to device 640.

A preferred method of using smart container assembly 10 to transport a material includes: providing a smart container assembly 10; electronically recording data relating to a material to be transported within the container assembly 10; placing the material to be transported within storage cavity 140 of container 100 of container assembly 10; at least partially hermetically sealing the opening used to fill the storage cavity 140 with a dip tube assembly extending into the storage cavity; transporting the container assembly 10 containing the material to be transported to a desired location; coupling the container assembly 10 to a processing unit 640 having a device 360 capable of electronically querying the container assembly; utilizing device 360 to electronically query the container assembly for information related to the contents or transportation of the container assembly 10; utilizing the transported material in processing unit 640 only if the contents and/or handling of the container assembly meet a standard programmed into or obtainable by the processing unit. It is contemplated that alternative methods may reorder some of the steps, may utilize less than all of the steps, or may incorporate additional steps.

It is contemplated that making the dip tube assembly part of the container by sealing it into the container immediately after filling the container and not using it with any other storage container assemblies will eliminate the introduction of dried material by movement of a dip tube between containers. It is also contemplated that the inner threads 212 of connector 210 and any connector or cap/plug designed to screw into connector 210 may have higher tolerances than the threads of orifice 120 with a resulting decrease in the likelihood of small leaks forming. Leaks forming between the dip tube assembly connector 210 and orifice 120 are less problematic as dip tube assembly is not removed so dried material will be less likely to escape the seal area between connector 210 and the threads of orifice 120.

Many different materials may be stored within container assembly 10. However, it is contemplated that the container assembly 10 may be particularly suited for use with spin-on-materials, including glass and organic polymers, used as dielectrics or planarization materials, and spin-on-dopants such as are commercially available for Honeywell International Inc.

Thus, specific embodiments and applications of smart container assemblies have been disclosed. It should be apparent, however, to those skilled in the art that many more modifications besides those already described are possible without departing from the inventive concepts herein. In particular, the methods and devices disclosed herein may be applicable in other applications than those disclosed herein. Thus, the inventive concepts are likely to be applicable to, among others, pharmaceutical and agricultural applications. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A smart container assembly comprising:

a storage container that includes a monitoring assembly receiving cavity, a dip tube orifice, an outer wall surrounding and defining a storage cavity;

a dip tube assembly hermetically sealed to the perimeter of the dip tube orifice;

a monitoring assembly positioned and removably retained within the monitoring assembly receiving cavity; and a dip tube seal cap positioned within and hermetically sealed to an end of the dip tube assembly, the dip tube assembly and seal cap hermetically sealing the storage cavity.

2. The smart container assembly of claim 1, further comprising:

a sensing mechanism;

an I/O interface;

and a recording mechanism electrically coupled to both the sensing mechanism and the I/O interface for recording data obtained from both the sensing mechanism and the I/O interface.

3. The assembly of claim 1 wherein the recording mechanism comprises at least a first sub-mechanism and a second sub-mechanism wherein the first sub-mechanism is electrically coupled to the sensing mechanism and the second sub-mechanism is electrically coupled to an input portion of the I/O interface.

4. The assembly of claim 3 wherein the I/O interface comprises a first sub interface electrically coupled to the first sub-mechanism of the recording mechanism and a second sub interface coupled to the second sub-mechanism of the recording mechanism.

5. The assembly of claim 1, wherein the monitoring assembly receiving cavity is sized and dimensioned to receive and retain the monitoring assembly, the receiving cavity having an environment more similar to the environment of the storage cavity than to the environment outside of the container assembly in regard to at least one condition the monitoring assembly is designed to monitor.

6. The assembly of claim 1, wherein the monitoring assembly receiving cavity is sized and dimensioned to receive and retain the monitoring assembly, the receiving cavity protruding into but being hermetically isolated from the storage cavity.

7. The assembly of claim 1 wherein the removal of the seal cap or dip tube assembly is the only way to break the hermetic seal of the storage cavity without creating a new opening into the storage cavity.

8. The assembly of claim 7 wherein the seal cap may be removed without breaking the hermetic seal between the dip tube assembly and the container, removal of the seal cap providing an outlet for any material stored in the storage cavity from the storage cavity, wherein any material flowing out of the storage cavity through the opening created by removal of the seal cap must flow through the dip tube of the dip tube assembly.

9. A method of transporting a material comprising:

providing the smart container assembly of claim 1;

placing the material to be transported within the container assembly;

transporting the container assembly containing the material to be transported; and electronically querying the container assembly for information related to the contents or transportation of the container assembly.

10. The method of claim 9 further comprising electronically recording, prior to transportation of the container assembly, data relating to the material to be transported within the container assembly.

11. The method of claim 10 wherein electronically querying the container results in the container providing at least some of the electronically recorded data relating to the material transported within the container assembly.

12. The method of claim 9 wherein electronically querying the container results in the container providing information relating to the conditions the material was subjected to during transportation.

13. The method of claim 9 further comprising, after transportation of the container assembly, coupling the container to a processing unit programmed to query the container for information relating to both the material transported within the container assembly and the conditions the material was subjected to during the transportation, and also programmed to use the material within the container assembly only if the contents and handling of the container assembly meet a standard programmed into or obtainable by the processing unit.

14. The method of claim 13 wherein placing the material within the container assembly comprises at least partially hermetically sealing an opening into a storage cavity containing the material with a dip tube assembly extending into the storage cavity.

15. The method of claim 14 wherein the material placed within the container assembly is a spin-on material.

16. The method of claim 15 wherein the material placed within the container assembly is a glass or organic polymer.

* * * * *